US005960565A

United States Patent [19]

Lochbaum

[11] Patent Number: 5,960,565

[45] Date of Patent: Oct. 5, 1999

[54] ADJUSTABLE AQUATIC EXERCISE SHOE

[76] Inventor: Kenneth Lochbaum, 3002 E. 38 St., Erie, Pa. 16510-2924

[21] Appl. No.: 08/811,342

[22] Filed: Mar. 4, 1997

Related U.S. Application Data

[60] Provisional application No. 60/012,961, Mar. 7, 1996.

[51] Int. Cl.[6] ..... A43B 5/08; A43B 3/12; A43C 11/00

[52] U.S. Cl. ..... 36/8.1; 36/11.5; 36/50.1

[58] Field of Search ..... D2/916, 919, 923, D2/943, 896, 903; 36/105, 69, 9 R, 11.5, 8.1, 89, 50.1, 51, 92, 58.5, 58.6, 8.2, 97

[56] References Cited

U.S. PATENT DOCUMENTS

| | | | |
|---|---|---|---|
| D. 321,084 | 10/1991 | Miurer et al. | D2/265 |
| D. 348,977 | 7/1994 | Koh | D2/969 |
| D. 390,343 | 2/1998 | Chen | D2/903 |
| 440,513 | 11/1890 | Siegenthaler | 36/58.5 |
| 494,598 | 4/1893 | Russell | 36/11.5 |
| 1,088,309 | 2/1914 | Weidt | 36/11.5 |
| 1,486,630 | 3/1924 | Burnett | 36/11.5 |
| 1,572,213 | 2/1926 | Lucas | 36/89 |
| 1,982,906 | 12/1934 | Dawes | 36/51 |
| 2,177,571 | 10/1939 | Kirke | 36/11.5 |
| 2,185,762 | 1/1940 | Cox | 36/8.1 |
| 2,190,982 | 2/1940 | Gilbert et al. | 36/11.5 |
| 2,227,352 | 12/1940 | Krasnosky | 36/30 |
| 2,259,273 | 10/1941 | Smith | 36/11.5 |
| 2,451,372 | 10/1948 | Ballenger | 36/11.5 |
| 2,466,373 | 4/1949 | Cain | 36/28 |
| 2,466,580 | 4/1949 | Dalbey | 36/11.5 |
| 2,518,649 | 8/1950 | Tydings et al. | 36/8.5 |
| 2,860,425 | 11/1958 | Jackson | 36/58.5 |
| 2,957,253 | 10/1960 | Metzler | 36/11.5 |
| 3,408,752 | 11/1968 | Loumann | 36/105 |
| 4,178,703 | 12/1979 | Pols | 36/105 X |
| 4,270,285 | 6/1981 | Antonius | 36/51 X |
| 4,282,657 | 8/1981 | Antonius | 36/50.1 |
| 4,753,022 | 6/1988 | Gasbarro | 36/29 |
| 4,899,468 | 2/1990 | Richburg et al. | 36/11.5 X |
| 5,205,071 | 4/1993 | Hergenroeder | 36/8.1 |
| 5,266,062 | 11/1993 | Runckel | 441/64 |
| 5,274,932 | 1/1994 | Malloy | 36/114 |
| 5,377,430 | 1/1995 | Hatfield et al. | 36/51 |
| 5,651,195 | 7/1997 | Clancy | 36/50.1 X |

*Primary Examiner*—B. Dayoan
*Attorney, Agent, or Firm*—Lovercheck and Lovercheck

[57] ABSTRACT

An aquatic exercise shoe having an upper made up of a vamp, a counter, a heel and an instep part. A foot receiving an opening is provided in the upper between the vamp and the counter. A heel strap is attached to the counter and has ends attached to the instep. Cross straps are provided each having a first end attached to the heel and extends across the opening and attached to the instep. The straps are self adjusting by opening and closing. Button holes are provided in the strap ends to receive buttons attached to the instep part to adjust the length of the strap. Holes are formed in the sole to drain water from the inside of the shoe.

22 Claims, 2 Drawing Sheets

ADJUSTABLE AQUATIC EXERCISE SHOE

BACKGROUND OF THE INVENTION

This application claims the benefit of U.S. Provisional Application Ser. No. 60/012,961 filed Mar. 7, 1996.

This invention relates to footwear, specifically footwear that enhances the ability of the wearer to actively engage in water sports or activities without the footwear being pulled off of their feet during kicking or swimming activities, for example.

In the design and construction of shoes, straps have been employed to retain the shoes on the wearer's feet. In the Meltzer patent (U.S. Pat. No. 2,957,253) two crossing straps and a heel strap are employed to secure the shoe to the foot. This arrangement of straps is not suitable for the difficult water use contemplated by the structure of the present invention.

Applicant is aware of the following U.S. Pat. Nos.: 494,598; 1,088,309; 1,486,630; 2,177,571; 2,190,982; 2,227,352; 2,259,273; 2,451,372; 2,466,373; 2,466,580; 2,518,649; 2,957,253; 4,753,022; 5,205,071; 5,266,062; and, 5,274,932.

SUMMARY OF THE INVENTION

This unique water shoe is constructed in such a manner that it will stay on the foot of the person wearing it while the person is engaged in any water sport or activity including swimming, jumping, running, walking, use of exercise equipment, or other activities. Because of its three strap design, the shoe will stay on the foot during all sports held in the water.

The unique features of the three strap design gives a person a chance to start their day in the water and proceed with any activity without exchange or removal of the shoe as would be necessary with any other shoe in swimming or jumping. In these functions, thrust, force, or water pressure would "kick off" other designs of shoes.

The heel strap is secured to the sole at each side of the shoe at a point between the securing points of the crossing straps on each side of the shoe. The crossing straps are affixed to the sole adjacent the point where the heel begins to narrow. Each crossing strap extends forwardly and crosses the foot at the front of the wearer's ankle and then extends downwardly where it attaches to the sole at a point adjacent the front of the wearer's ankle.

The straps are all elastic, and closely gathered around the wearer's ankle. To put on the shoe, the straps are engaged by hand and stretched outwardly to permit the foot to be placed in the shoe. When released, the straps snugly and securely engage the wearer at the ankle across the top of the foot.

The cross straps are adjustable to swollen feet, handicapped feet, high or low arches and feet with various deformities.

The heel strap places a counter force against the cross straps and provides a sufficient amount of opposing force to keep the foot in the shoe.

The strap design will also take a lot of pressure off the material of the shoe and cause the shoe to last longer due to less stress on the stitching, glue and other material of the shoe. The holes in the sole allow water to escape, thus making the shoe safer by not spreading water on the floor adjacent the edge of the water in a pool, and makes the shoes more comfortable.

It is an object of the present invention to provide an improved aquatic exercise shoe.

It is another object of the present invention to provide an aquatic exercise shoe that is simple in construction, economical to manufacture and simple and efficient to use.

It is another object of the present invention to provide a shoe that will not come off the wearer during ordinary aquatic exercise.

It is another object of the present invention to provide a shoe with drain holes in the sole.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

DESCRIPTION OF THE PREFERRED EMBODIMENT(S)

Figure 1:
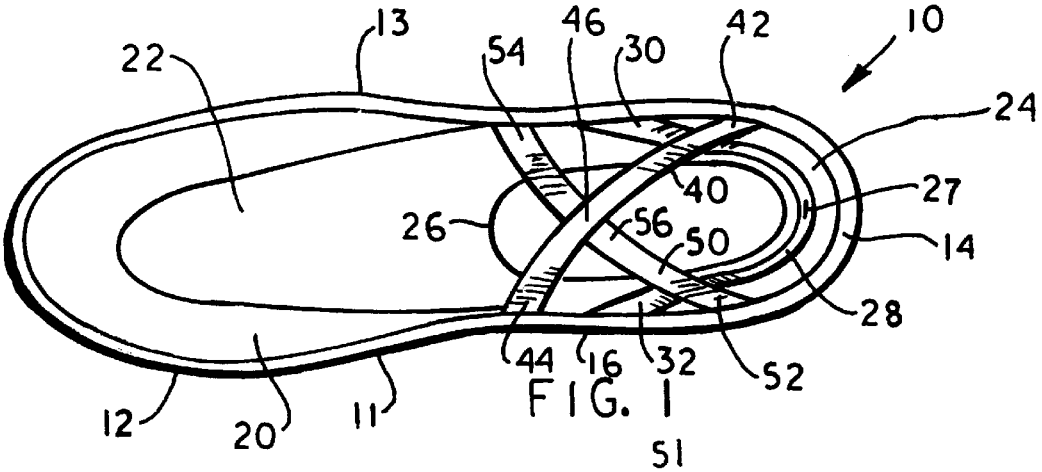
FIG. 1 is a top view of a shoe according to the a invention.
Figure 2:
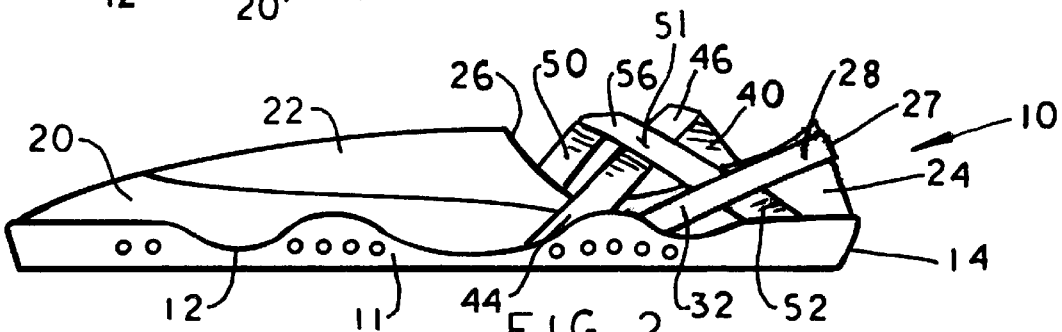
FIG. 2 is a side view of the shoe according to the invention.
Figure 3:
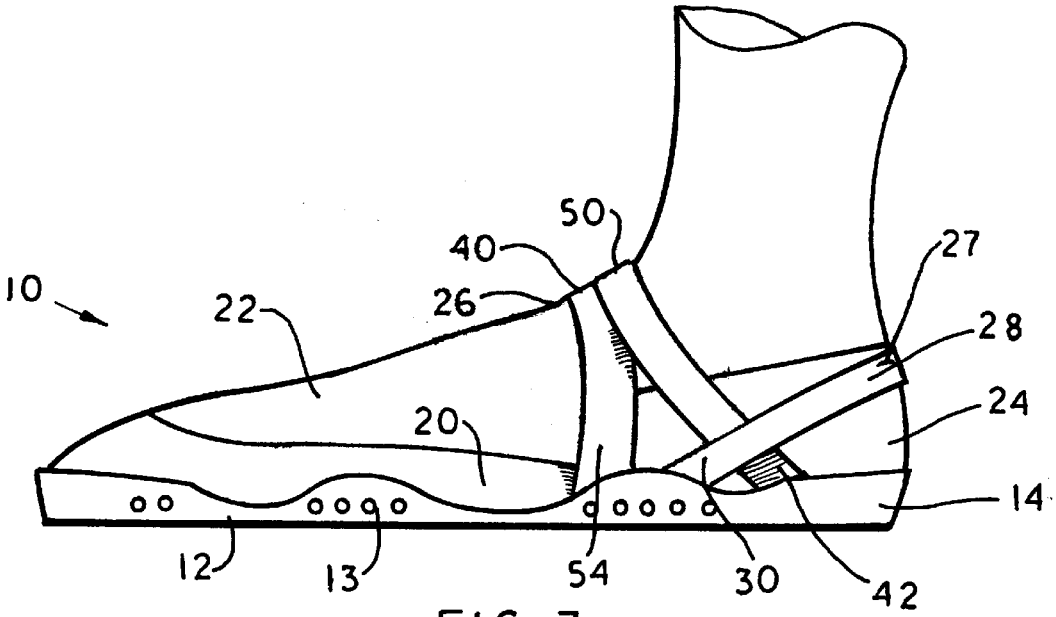
FIG. 3 is a side view of the shoe as it would be worn on a foot according to the invention.

Now with more particular reference to the drawings, as shown in FIGS. 1 through 3, shoe 10 for use in water applications such as swimming or aquatic exercise is shown having first side 13, and second side 11 comprising sole 12, heel 14, instep part 16 and upper 20.

Upper 20 comprises vamp 22 and counter 24. Fastening means fastening upper 20 to sole 12 may have any means familiar to those skilled in the art for fastening sole 12 and heel 14 to upper 20. A foot receiving upper opening 26 is formed in upper 20 between counter 24 and vamp 22.

Sole 12, heel 14 and instep 16 can be attached to upper 20 by any means familiar to those skilled in the art. Heel strap 28 has first end 30 attached to first side 13 of shoe 10 and second end 32 attached to second side 11 of shoe 10. Intermediate part 27 of heel strap 28 extends around the upper edge of counter 24. Heel strap may be attached to counter 24 adjacent its upper edge by fastening means 27 which may be by sewing, by adhesive or other well known fastening means.

First cross strap 40 has first end 42 attached to heel 14 on first side 13 of shoe 10. Intermediate part 46 of first cross strap 40 overlies upper opening 26 in upper 20. Second end 44 of first cross strap 40 is fixed to instep 16 and second side 11 of shoe 10.

Second cross strap 50 has first end 52 attached to heel 14 on second side 11 of shoe 10, and intermediate part 56 extends across upper opening 26 and second end 54 is attached to first side 13 of shoe 10 at instep part 16. First strap 40 may be fastened to second strap 50 by fastening means 51.

Heel strap 28, first cross strap 40 and second cross strap 50 are all made of elastic material. The elastic material of the heel strap and cross straps adjusts to the size and shape of the foot. Even where the foot is swollen or mis-shaped.

Figure 4:
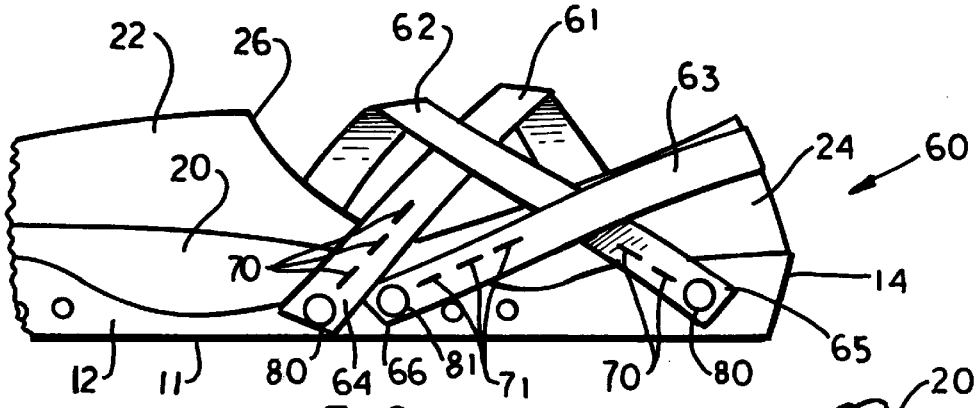
FIG. 4 is a partial side view of an adjustable length strap embodiment of the shoe according to the invention.
Figure 5:
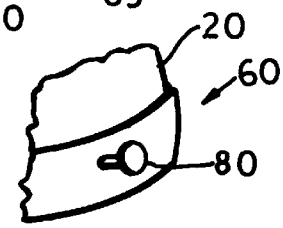
FIG. 5 is a partial isometric view of the side of a show with a rivet or button and the adjustable length strap used with the embodiment of FIG. 4.
Figure 6:
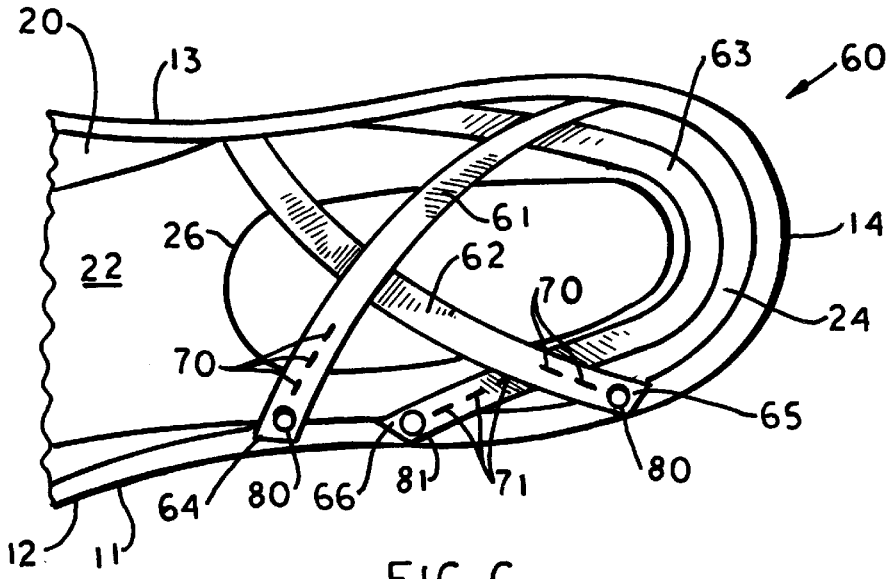
FIG. 6 is a partial top view of an adjustable length elastic strap embodiment of the shoe according to the invention.

In another embodiment as shown in FIGS. 4 through 6, shoe 60 has elastic cross straps 61,62 and heel strap 63 can be further adjusted to the size and shape of the foot by adjusting means. The adjusting means may comprise cross straps 61,62 having ends 64,66 that are not attached to second side 11 of shoe 10. The fastening means may be buttons or rivets 80 adapted to engage button holes 70 in ends 64,65 of cross straps 61,62. The fastening means may further be button or rivet 81 adapted to engage button holes 71 in end 66 of heel strap 63. Buttons 80,81 can be attached to instep part 16. Cross straps 61,62 can be adjusted by means of buttons 80 and button holes 70 to fit various sizes and shapes of feet. End 66 of heel strap 63 has button holes 71 which can receive buttons 81 on shoe 60 to adjust the length of heel strap 63 to accommodate feet of different sizes and shapes.

In a preferred embodiment, the heel strap is positioned to engage the foot of a wearer above the calcaneus bone and above the insertion of the gastroc tendon on the calcaneus bone. The cross straps cross the foot of a wearer at a position anterior to the mortus joint of the ankle.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A shoe for use in aquatic exercise comprising a sole, heel, instep, and an upper having a vamp and counter;

said vamp being attached to said instep being attached to said heel;

a foot receiving upper opening in said upper between said vamp and said counter;

a heel strap having a first end and first fastening means attaching said first end to said instep on said first side of said shoe;

said heel strap having a second end and second attaching means attaching said second end of said heel strap to said instep on the second side of said shoe;

said first fastening means and said second fastening means are adjustable to adjust the length of said heel strap.

2. The shoe recited in claim 1 wherein said heel strap extends upwardly and rearwardly to a point adjacent the calcaneus bone of a wearer's foot.

3. The shoe recited in claim 1 wherein said first and second cross straps cross a wearer's foot adjacent a point anterior to the mortus joint of the ankle.

4. A shoe for use in aquatic exercise comprising a sole, heel, instep, and an upper having a vamp and counter;

said vamp being attached to said instep being attached to said heel;

a foot receiving upper opening in said upper between said vamp and said counter;

a heel strap having a first end and first fastening means attaching said first end to said instep on said first side of said shoe;

said heel strap having a second end and second attaching means attaching said second end of said heel strap to said instep on the second side of said shoe;

said first fastening means and said second fastening means comprise adjustable fastening means.

5. The shoe recited in claim 4 wherein said adjustable fastening means comprises buttons attached to said shoe and button holes in said ends of said heel strap for adjusting the length of said heel strap.

6. A shoe for use in aquatic exercise comprising a sole, heel, instep, and an upper having a vamp and counter;

said vamp being attached to said instep being attached to said heel;

a foot receiving upper opening in said upper between said vamp and said counter;

a heel strap having a first end and first fastening means attaching said first end to said instep on said first side of said shoe;

said heel strap having a second end and second attaching means attaching said second end of said heel strap to said instep on the second side of said shoe;

a first cross strap having a first end is fixed to said shoe adjacent said heel on a first side of said shoe, an intermediate part extending across said opening in said upper;

first fastening means attaching said second end of said first cross strap to said shoe adjacent said instep on a second side of said shoe.

7. The shoe recited in claim 6 wherein said heel strap extends upwardly and rearwardly to a point adjacent the calcaneus bone of a wearer's foot.

8. The shoe recited in claim 6 wherein said first and second cross straps cross a wearer's foot adjacent a point anterior to the mortus joint of the ankle.

9. The shoe recited in claim 6 wherein a second cross strap has a first end attached to said heel at a second side of said shoe;

an intermediate part of said second cross strap extending across said opening in said upper;

a second cross strap fastening means attaching said second end of said second cross strap to said shoe adjacent said instep.

10. The shoe recited in claim 9 wherein said first fastening means and said second fastening means are adjustable.

11. A shoe for use in aquatic exercise comprising a sole, heel, instep, and upper having vamp and counter;

said vamp being attached to said instep being attached to said heel;

a foot receiving upper opening in said upper between said vamp and said counter;

a first elastic cross strap having a first end is fixed to said shoe adjacent said heel on a first side of said shoe, an intermediate part extending across said opening in said upper;

first attaching means attaching said second end of said first elastic cross strap to said shoe adjacent said instep on a second side of said shoe;

a second elastic cross strap has a first end attached to said heel at a second side of said shoe;

an intermediate part of said second cross strap extending across said opening in said upper;

a second elastic cross strap attaching means attaching said second end of said second elastic cross strap to said insert adjacent said instep;

said first attaching means and said second attaching means are adjustable;

said first attaching means and said second attaching means comprise buttons are attached to said side edges of said instep and said first fastening means comprising first button holes in said first cross straps and second button holes in said second cross strap have said second button holes adapted to be received on said buttons to adjust the length of said cross straps.

12. A shoe for use in aquatic exercise comprising a sole, heel, instep, and upper having vamp and counter;

said vamp being attached to said instep being attached to said heel;

a foot receiving upper opening in said upper between said vamp and said counter;

an elastic heel strap having a first end and first fastening means attaching said first end to said instep on said first side of said shoe;

said elastic heel strap having a second end and second fastening means attaching said second end of said elastic heel strap to said instep on the second side of said shoe;

said first end of said elastic heel strap and said second end of said elastic heel strap each have spaced button holes therein;

buttons are attached to said instep part; and, said buttons are adapted to be selectively received in said button holes to adjust the length of said elastic heel strap.

13. An aquatic exercise shoe having an upper, an instep and a heel;

said upper comprising a vamp and a counter;

said counter with a foot receiving opening in said upper between said vamp and said counter;

said counter being attached to said heel;

said vamp being attached to said instep;

a heel strap have a first end attached to said shoe adjacent said instep at a first side of said shoe;

said heel strap has an intermediate part attached to said counter and spaced above said heel, a second end attached to said instep;

a first cross strap having a first end attached to said shoe adjacent said heel at a first side of said shoe and extending over said opening to a second side of said shoe and a second end on said first cross strap attached to said shoe adjacent said instep;

a second cross strap having a first end attached to said heel on a second side of said shoe with adjustable fastening means;

said second cross strap extending across said opening to a first side of said shoe;

said second end of said second cross strap being attached to said shoe with adjustable fastening means and said adjustable fastening means on said second cross strap;

said heel strap extends upwardly and rearwardly to a point adjacent the calcaneus bone of a wearer's foot;

said heel strap is attached to said counter of said shoe at an intermediate part;

said first and second cross straps are attached to each other at the intermediate parts thereof.

14. The aquatic exercise shoe recited in claim 11 wherein drain holes are formed in said sole.

15. The shoe recited in claim 13 wherein said heel strap extends upwardly and rearwardly to a point adjacent the calcaneus bone of a wearer's foot.

16. The shoe recited in claim 13 wherein said first and second cross straps cross a wearer's foot adjacent a point anterior to the mortus joint of the ankle.

17. The shoe recited in claim 13 wherein said first and second cross straps are attached to each other at the intermediate parts thereof.

18. The shoe recited in claim 13 wherein said first and second cross straps cross a wearer's foot adjacent a point anterior to the mortus joint of the ankle.

19. A shoe for use in aquatic exercise comprising a sole, heel, instep, and an upper having a vamp and counter;

said vamp being attached to said instep being attached to said heel;

a foot receiving upper opening in said upper between said vamp and said counter;

a heel strap having a first end and first fastening means attaching said first end to said instep on said first side of said shoe;

said heel strap having a second end and second attaching means attaching said second end of said heel strap to said instep on the second side of said shoe;

wherein first and second cross straps are attached to each other at the intermediate parts thereof.

20. A shoe for use in aquatic exercise comprising a sole, heel, instep, and an upper having a vamp and counter;

said vamp being attached to said instep being attached to said heel;

a foot receiving upper opening in said upper between said vamp and said counter;

a heel strap having a first end and first fastening means attaching said first end to said instep on said first side of said shoe;

said heel strap having a second end and second attaching means attaching said second end of said heel strap to said instep on the second side of said shoe;

drain holes are formed in said sole.

21. The shoe recited in claim 20 wherein said heel strap extends upwardly and rearwardly to a point adjacent the calcaneus bone of a wearer's foot.

22. The shoe recited in claim 20 wherein said first and second cross straps cross a wearer 's foot adjacent a point anterior to the mortus joint of the ankle.

* * * * *